US011008519B2

(12) United States Patent
Schneider et al.

(10) Patent No.: US 11,008,519 B2
(45) Date of Patent: May 18, 2021

(54) RENEWABLE ENERGY USE IN OIL SHALE RETORTING

(71) Applicant: Kerogen Systems, Incorporated, Mill Valley, CA (US)

(72) Inventors: Otto John Schneider, Mill Valley, CA (US); Paul S. Owen, London (GB)

(73) Assignee: Kerogen Systems, Incorporated, Mill Valley, CA (US)

( * ) Notice: Subject to any disclaimer, the term of this patent is extended or adjusted under 35 U.S.C. 154(b) by 0 days.

(21) Appl. No.: 16/996,538

(22) Filed: Aug. 18, 2020

(65) Prior Publication Data

US 2021/0054290 A1 Feb. 25, 2021

Related U.S. Application Data

(60) Provisional application No. 62/888,842, filed on Aug. 19, 2019.

(51) Int. Cl.
*C10B 1/04* (2006.01)
*C10G 1/04* (2006.01)
(Continued)

(52) U.S. Cl.
CPC ..... *C10G 1/04* (2013.01); *C10B 1/04* (2013.01); *C10B 17/00* (2013.01); *C10B 19/00* (2013.01);
(Continued)

(58) Field of Classification Search
CPC .. C10G 1/02; C10G 1/04; C10B 17/00; C10B 19/00; C10B 21/08; C10B 49/06; C10B 51/00; C10B 53/06; C10B 1/04
See application file for complete search history.

(56) References Cited

U.S. PATENT DOCUMENTS 2,586,703 A 2/1952 Odell
3,432,397 A * 3/1969 Berg ..... C10B 47/18 201/32
(Continued)

FOREIGN PATENT DOCUMENTS

WO 2015094384 A1 6/2015

OTHER PUBLICATIONS

Bunger, "Shale Oil Value Enhancement Research", DOE Award No.—DE-AC21-93MC29240, Jul. 12, 2007 [https://pdfs.semanticscholar.org/2e3f/72852b22ee7db6ff99e9e8787f5369095220.pdf].

*Primary Examiner* — Jonathan Miller
(74) *Attorney, Agent, or Firm* — O'Connor & Company; Ryan P. O'Connor

(57) ABSTRACT

A method of retorting oil shale is provided, comprising: continuously feeding oil shale into a retorting unit; heating the retorting unit using renewable electrical energy; converting the oil-shale kerogen into kerogen oil; conveying a cross-flow sweep gas across a moving bed of the oil shale, to carry the kerogen oil out of the retorting unit; recovering the kerogen oil; and recovering spent oil shale. The combination of electrical heating and cross-flow retorting achieves uniform heating to optimize the production of hydrocarbons. A system for retorting oil shale is also provided, comprising: a retorting unit; an inlet for continuously feeding oil shale; electrical-energy elements within the retorting unit; an inlet for conveying a cross-flow sweep gas through the retorting unit; and an outlet for the cross-flow sweep gas carrying the kerogen oil. The principles of the invention may be applied to ex situ systems, in situ systems, or hybrid systems.

20 Claims, 7 Drawing Sheets

(51) Int. Cl.

| | |
|---|---|
| ***C10B 53/06*** | (2006.01) |
| ***C10B 49/06*** | (2006.01) |
| ***C10B 19/00*** | (2006.01) |
| ***C10B 21/08*** | (2006.01) |
| ***C10B 51/00*** | (2006.01) |
| ***C10B 17/00*** | (2006.01) |

(52) U.S. Cl.
CPC ..... *C10B 21/08* (2013.01); *C10B 49/06* (2013.01); *C10B 51/00* (2013.01); *C10B 53/06* (2013.01)

(56) References Cited

U.S. PATENT DOCUMENTS 4,452,689 A * 6/1984 Russum ..... C10G 1/02 166/261
4,464,247 A * 8/1984 Thacker ..... C10G 1/02 201/31
4,495,056 A * 1/1985 Venardos ..... C10G 1/02 208/251 R
5,360,537 A * 11/1994 Strumskis ..... C10B 1/04 201/20
7,229,547 B2 * 6/2007 Merrell ..... F26B 17/1416 208/81
10,829,693 B2 * 11/2020 Otterstrom ..... C10B 1/04
10,858,592 B2 * 12/2020 Stites ..... B01D 3/007
2009/0071652 A1 * 3/2009 Vinegar ..... E21B 43/24 166/303
2015/0203776 A1 * 7/2015 Vinegar ..... E21B 43/24 44/620
2016/0075953 A1 * 3/2016 Maxwell ..... E21B 43/24 208/402
2018/0355254 A1 * 12/2018 Stites ..... B01D 3/10

* cited by examiner

RENEWABLE ENERGY USE IN OIL SHALE RETORTING

PRIORITY DATA

This patent application is a non-provisional application claiming priority to U.S. Provisional Patent App. No. 62/888,842, filed on Aug. 19, 2019, which is hereby incorporated by reference herein.

FIELD OF THE INVENTION

The present invention generally relates to utilizing renewable energy for retorting oil from oil shale (kerogen-containing rock).

BACKGROUND OF THE INVENTION

Oil shale deposits worldwide have long been identified and studied. Bound within this oil shale is kerogen, a complex of massive organic macromolecules. Historically, processing oil shale and extracting hydrocarbons from the kerogen contained within have focused on production of synthetic crude oil. Those approaches fail commercially because the resulting synthetic crude oil is of low quality and low value. Typically, the synthetic crude oil produced is burned to generate power or processed further into fossil fuels via conventional oil refineries. For typical refineries, this additional processing is a costly extra step (cost that is already subject to volatile pricing).

This commodity approach fails to capture the real value of the numerous chemical components contained within properly processed kerogen. These conventional approaches succeed only when crude oil prices are very high—and only if operations are very large, typically costing several billion dollars per plant and creating substantial infrastructure and environmental pressures.

Decomposition of the kerogen macromolecules to form more valuable smaller molecules is achieved by breaking chemical bonds, typically carbon-carbon bonds. Breaking chemical bonds is an endothermic process and thus external energy, in the form of heat, must be supplied. The decomposition of kerogen in this manner is typically called pyrolysis, and the process of conducting pyrolysis is typically called retorting.

Pre-existing art for the retorting of kerogen has been undertaken using three approaches, referred to as ex situ, in situ, and a hybrid of both.

Classical, ex situ retorting is considered by many as the most cost-effective, proven way to retort kerogen. Typical methods used include those developed by the U.S. Department of Energy which funded and conducted many studies. These studies resulted directly or indirectly in various commercially tested methods such as "Paraho", "Enefit", "Petrosix", "ATP" and others for producing synthetic crude oil. Ex situ technologies are applied to kerogen formations at or near the earth's surface.

In situ retorting has perhaps seen the greatest amount of commercial investment but has seen no commercial successes. Investment in various in situ retorting approaches has been funded by Shell, Union Oil, Tosco, Chevron, and others. In situ retorting is typically conducted on formations that are hundreds or thousands of feet below the earth's surface.

The hybrid approach involves retorting kerogen at or near the Earth's surface. A formation containing kerogen is excavated and the material, typically oil shale, is removed.

Systems to conduct retorting are installed within the excavated volume and crushed oil shale is returned into the excavation, covering the retorting system. Efforts to develop the technology for this approach were undertaken by Red Leaf Resources Inc.

All three retorting approaches—ex situ, in situ, and hybrid—typically obtain some or all of the required energy by direct or indirect combustion of hydrocarbons. These hydrocarbons may be extracted from the kerogen or be sourced externally, e.g. natural gas. The most energy-efficient, existing methods use the waste products of the retorting process. These include the very light hydrocarbons (to $C_6$ or $C_7$) and other gases and/or carbon left in the spent retorted mineral. There are schemes where the energy value in these waste products is enough to provide the entirety of the energy needed for retorting.

Despite many attempts at commercializing the existing art, only a few have succeeded, and these are due to unique local circumstances. Most of the commercialization attempts have failed as product values have not supported project cost. Improvements in retorting oil shale are commercially needed.

SUMMARY OF THE INVENTION

The present invention addresses the aforementioned needs in the art, as will now be summarized and then further described in detail below.

Some variations of the invention provide a method of retorting oil shale containing kerogen, the method comprising:

(a) continuously or semi-continuously feeding oil shale into a heated retorting unit;

(b) heating the heated retorting unit, at least partially, using electrical energy;

(c) in the heated retorting unit, converting the kerogen into one or more retorted streams comprising kerogen oil in the form of a vapor, mist, and/or liquid;

(d) conveying a cross-flow sweep gas across a moving bed of the oil shale within the heated retorting unit, wherein the heated cross-flow sweep gas carries the kerogen oil out of the heated retorting unit;

(e) recovering or further processing the kerogen oil; and (f) recovering or further processing spent, kerogen-depleted oil shale.

In some embodiments, the method is ex situ oil-shale retorting. In other embodiments, the method is in situ oil-shale retorting, or includes in situ oil-shale retorting in a hybrid method.

The electrical energy in step (b) is at least partially renewable electrical energy. The renewable electrical energy may be selected from the group consisting of solar-generated electricity, wind-generated electricity, hydroelectricity, biomass-derived electricity, and combinations thereof.

In some embodiments, heating in step (b) is provided by resistive heating, dielectric heating, inductive heating, or a combination thereof.

When induction heating is used, oil shale is contacted with conductive media that heats up via induction. The conductive media may be contained in walls of, and/or internally fixed structures within, the heated retorting unit. Alternatively, or additionally, the conductive media may be a solid and/or a fluid that is continuously or semi-continuously introduced to, and recovered from, the heated retorting unit.

In some embodiments, the heated retorting unit is operated at a retorting temperature from about 250° C. to about 550° C., wherein the heated retorting unit is operated at a retorting pressure from about 1 bar to about 10 bar.

The cross-flow sweep gas may comprise at least 50 mol % carbon dioxide. The cross-flow sweep gas preferably comprises less than 1 mol % oxygen, such as less than 0.1 mol % oxygen.

In some embodiments, the ratio of mass flow rate of the cross-flow sweep gas to mass flow rate of the moving bed of the oil shale is from about 0.5 to about 2.0.

In some embodiments, the cross-flow sweep gas is preheated to a temperature from about 300° C. to about 450° C. prior to step (d). In these embodiments, the heated retorting unit is not heated solely with the electrical energy.

The direction of the cross-flow sweep gas and the direction of the moving bed of the oil shale form an angle that may be selected from about 60° to about 120°. In certain embodiments, the cross-flow sweep gas is perpendicular (90°) relative to the direction of the moving bed of the oil shale.

The method may further comprise generating a plurality of hydrocarbons from the kerogen oil by separations, reactions, or a combination thereof.

In various embodiments, the method further comprises producing one or more products selected from the group consisting of asphalt binder, high-cetane additives, odd and/or even numbered alpha-olefins, base oil stocks, paraffins, waxes including micro-crystalline waxes, amines, pyridines, aromatics, hydrogen sulfide, carbon monoxide, and carbon dioxide.

The present invention, in some variations, also provides a system for retorting oil shale containing kerogen, the system comprising:

(a) a heated retorting unit configured for converting kerogen into one or more retorted streams comprising kerogen oil in the form of a vapor, mist, and/or liquid;

(b) a first inlet configured for continuously or semi-continuously feeding oil shale into the heated retorting unit;

(c) one or more electrical-energy elements contained within, or in thermal communication with, the heated retorting unit;

(d) a second inlet configured for conveying a cross-flow sweep gas through the heated retorting unit;

(e) a first outlet configured for the heated cross-flow sweep gas carrying the kerogen oil; and (f) a second outlet configured for spent, kerogen-depleted oil shale.

The system may be an ex situ oil-shale retorting system, an in situ oil-shale retorting system, or a hybrid ex situ/in situ oil-shale retorting system.

In some embodiments, the heated retorting unit is a gravity-fed vertical heated retorting unit. In other embodiments, the heated retorting unit is a horizontal heated retorting unit, wherein the horizontal heated retorting unit contains mechanical means to convey the oil shale through the horizontal heated retorting unit.

The heated retorting unit may be a single-zone retorting unit or a multi-zone retorting unit (with e.g. 2, 3, 4 or more zones).

The one or more electrical-energy elements may include resistive heating elements.

The one or more electrical-energy elements may include dielectric heating elements.

The one or more electrical-energy elements may include induction heating elements. The induction heating elements may be contained in walls of the heated retorting unit. Alternatively, or additionally, the induction heating elements may be contained in internally fixed structures within the heated retorting unit. Alternatively, or additionally, the induction heating elements may be solids and/or fluids within the heated retorting unit. When induction heating elements are employed, the system further comprises an electromagnet in electromagnetic communication with the induction heating elements.

The direction of the second inlet and the direction of the first inlet form an angle that may be selected from about 60° to about 120°. In some embodiments, the angle is about 90° (perpendicular).

The system may further include one or more units configured for generating a plurality of hydrocarbons from the kerogen oil by separations, reactions, or a combination thereof.

BRIEF DESCRIPTION OF THE DRAWINGS

Various embodiments may be understood with reference to the drawings, which are not intended to limit the invention in any way.

Unless otherwise stated, supporting structures, trusses, frames, etc. are not shown in these figures to assist in clarity. In practice, external and internal bracing and support structures are included to ensure structural integrity of the unit operation.

Similarly power and control systems are not shown or are briefly indicated. It can be assumed that each means of electrical heating coexists with an appropriate power system. Although renewable energy is considered the optimal solution to providing the energy, the invention is not limited to renewable energy. Co-generation or grid-based energy are considered suitable where renewable sources are simply uneconomic or unavailable, or to supplement such sources.

Figure 1:
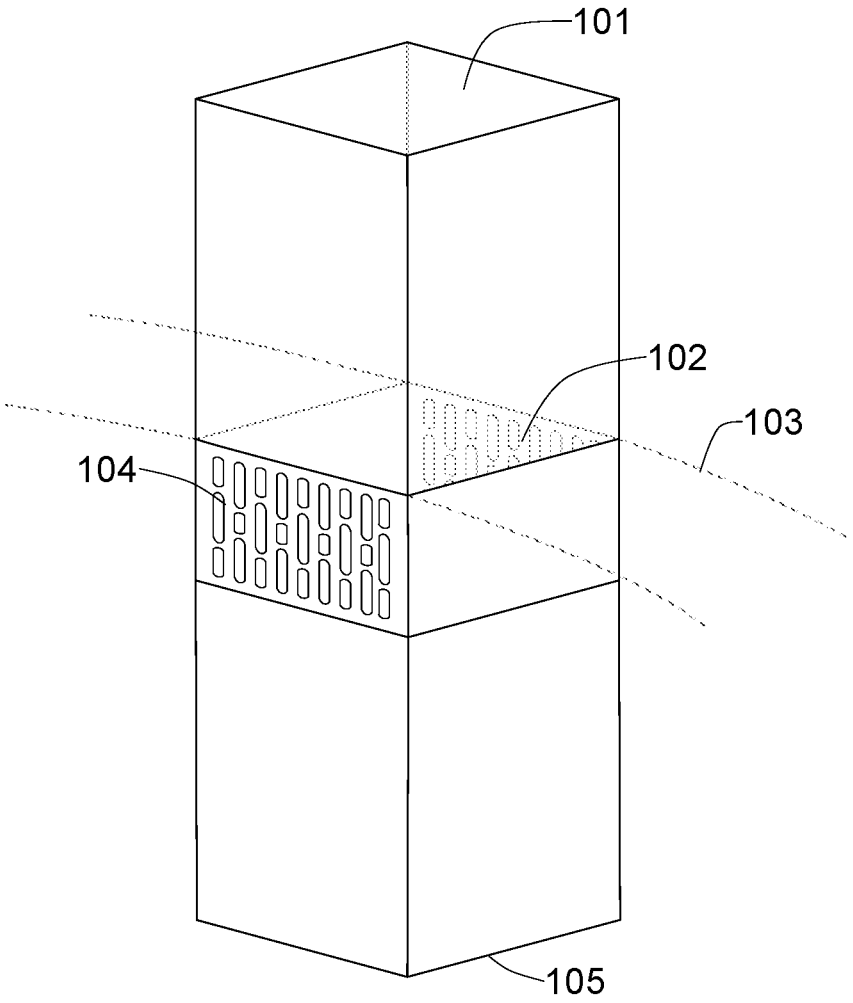

FIG. 1 depicts a simple chute configuration of a cross-flow retort, in some embodiments. In this implementation, gas flows across the retort entering (102) and exiting (104) via slotted panels. The dashed lines (103) indicate how this simple chute can be considered a segment of an annular implementation.

Figure 2:
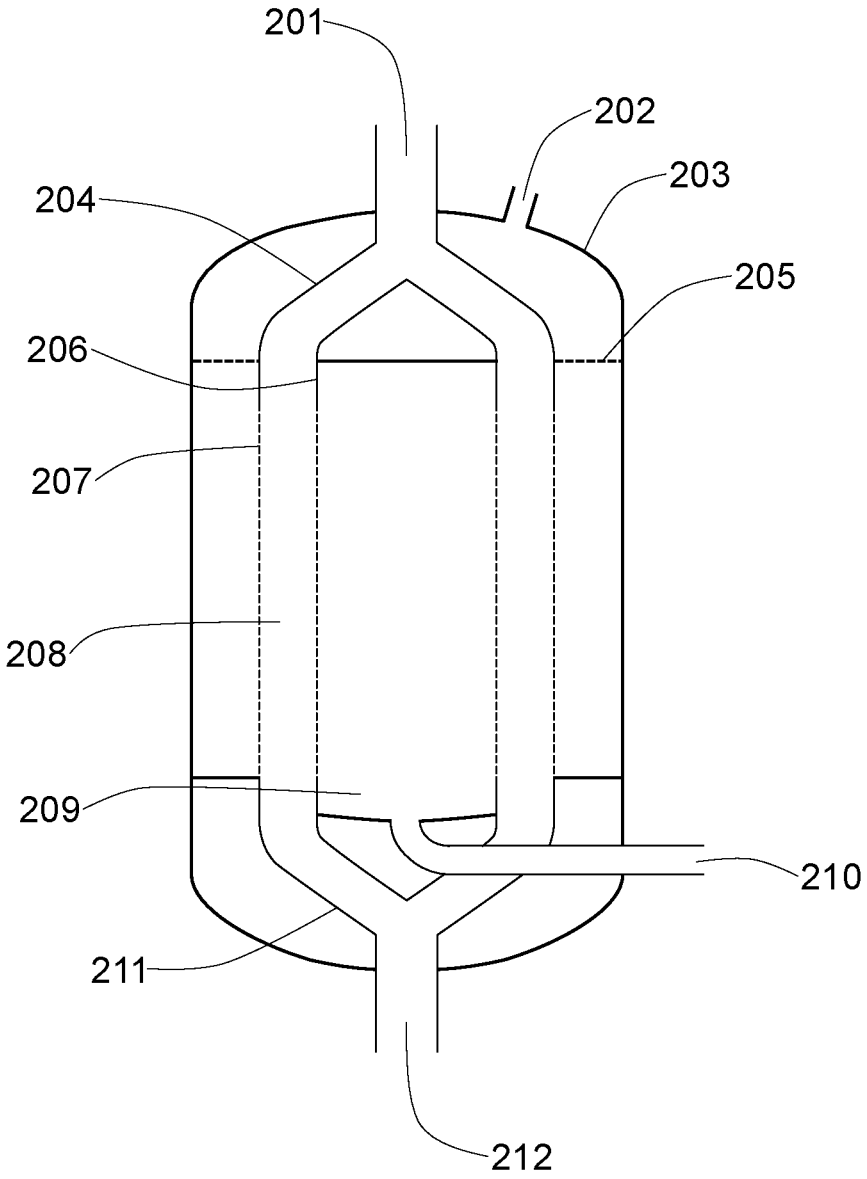

FIG. 2 depicts a cross-section through a single-zone annular cross-flow retort, in some embodiments. This implementation demonstrates a cross-flow of sweep gas entering (202) the upper containment vessel, progressing down through a distribution grate (205) and then across the flowing shale bed (208)—outward (207) to inward (206). It is possible to map between the annular cross-flow retort of FIG. 2 and the cross-flow retort chute in FIG. 1: 104 can be considered as 207, while 102 is equivalent to 206. This mapping is consistent throughout the retort implementations in the other figures, though the direction of gas flow or means of ingress and egress may differ.

Figure 3:
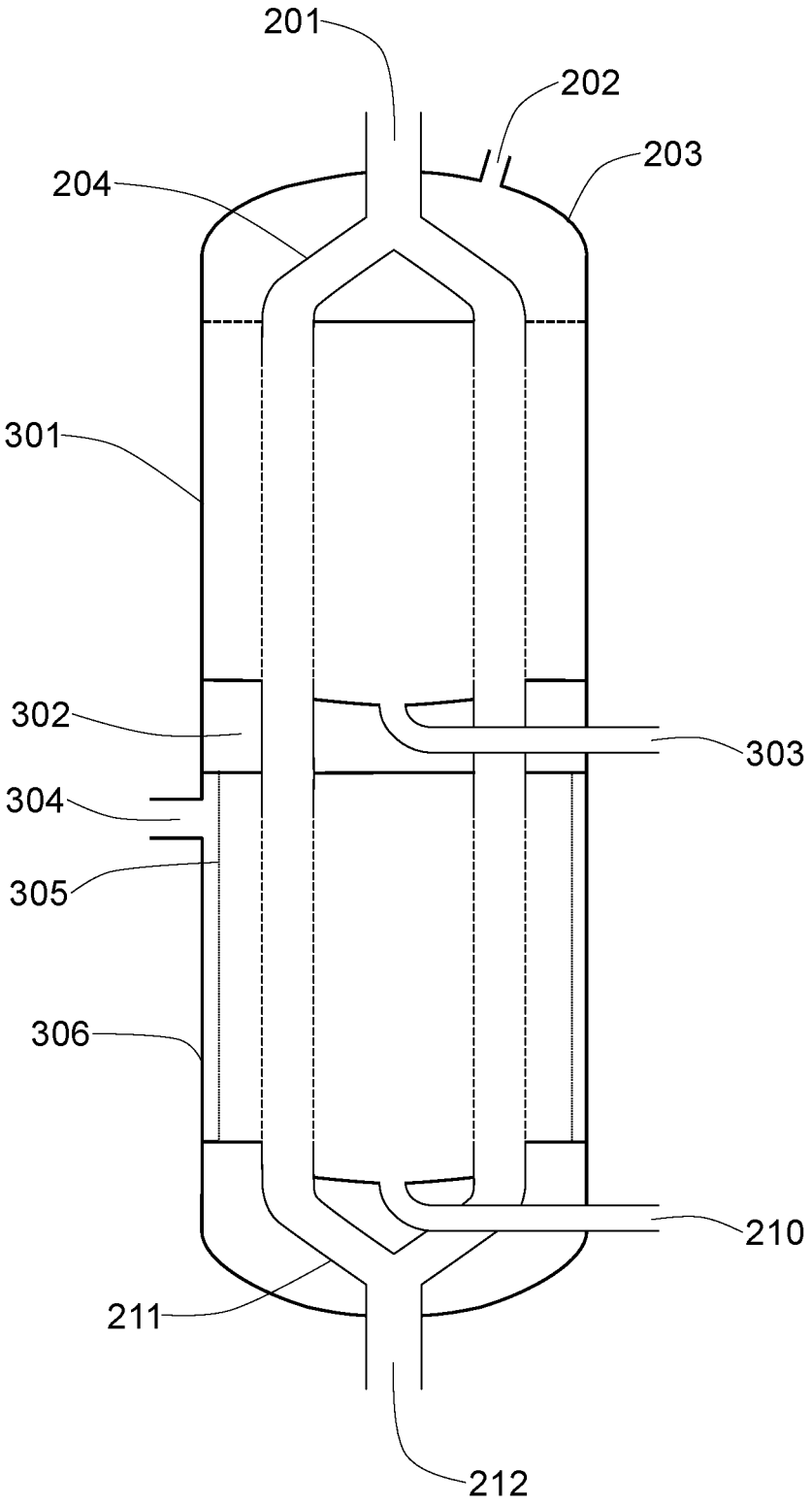

FIG. 3 depicts a dual-zone annular cross-flow retort, in some embodiments. This embodiment is an extension of the FIG. 2 single-zone retort to, in this case, a dual-zone configuration. Each zone may be operated under different regimes, contain additional materials, or be heated in different manners. As depicted here, there is no physical separation between the zones for the crushed shale flow—control of gas flows and pressures may be used to maintain separation.

Figure 4A:
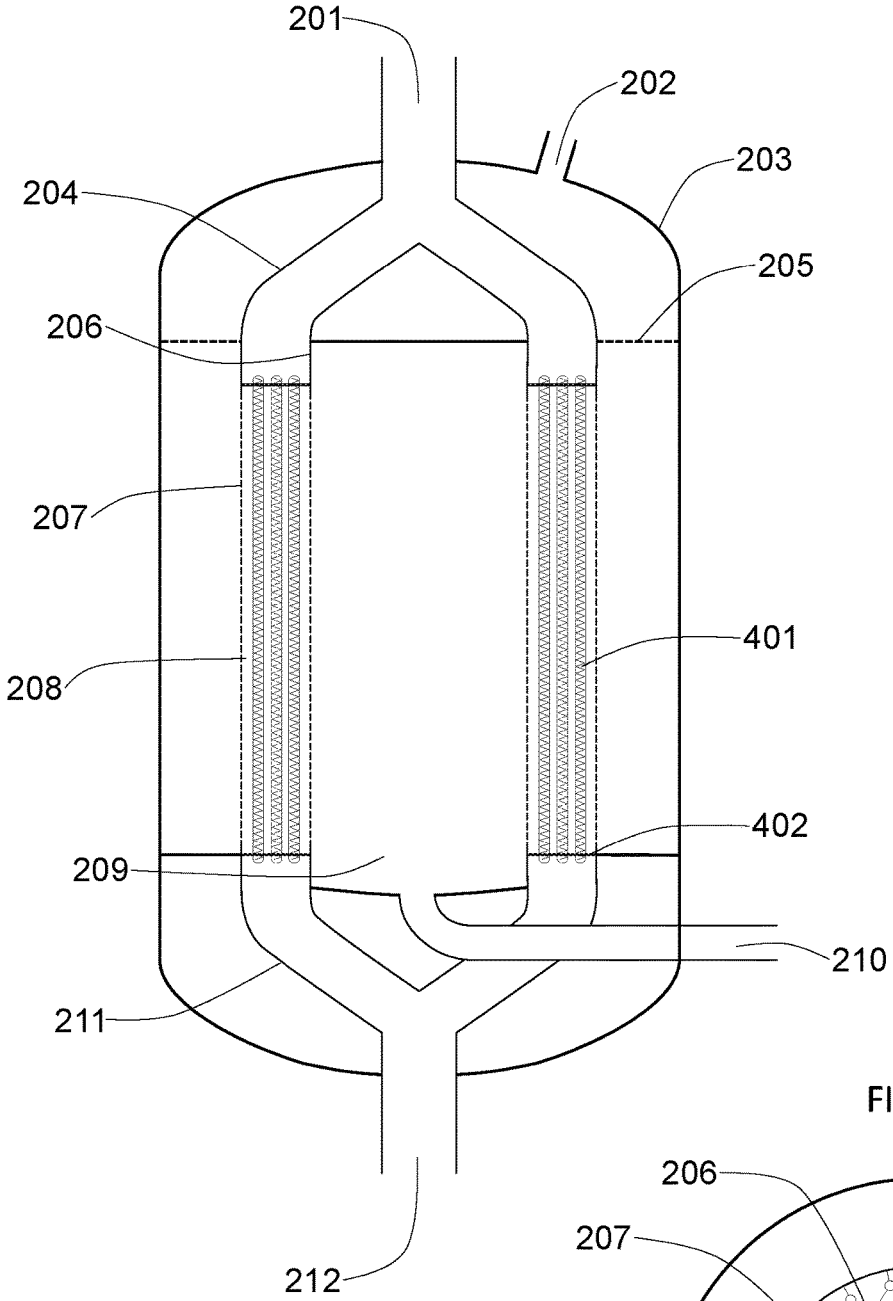

FIG. 4*a* depicts a dual-zone annular cross-flow retort, in some embodiments. FIG. 4*a* is an extension of FIG. 2, introducing resistive heating elements to assist in maintaining consistent temperatures in the shale. In this implementation gas is flowing from the containment vessel to the inner tube/vessel, as in FIG. 2.

Figure 4B:
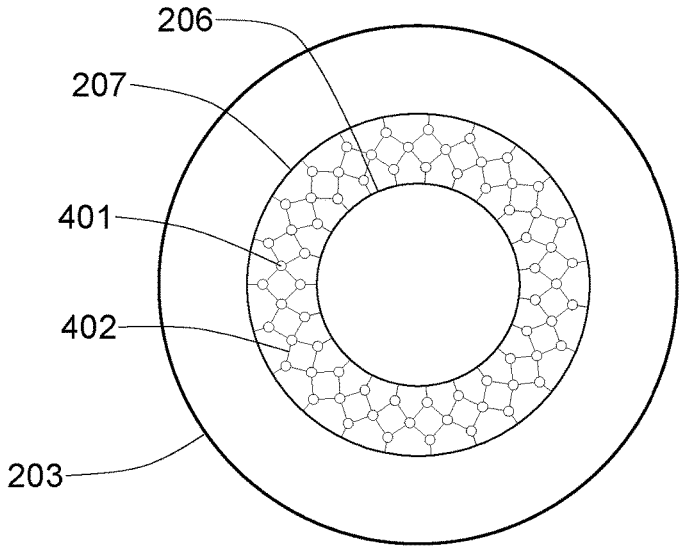

FIG. 4*b* is a plan view of FIG. 4*a*, depicting a certain embodiment of the placement of resistive heater tubes (401) within the retort. This exemplary arrangement of resistive heater tubes is intended to maintain a consistent temperature profile across the shale bed.

Figure 5A:
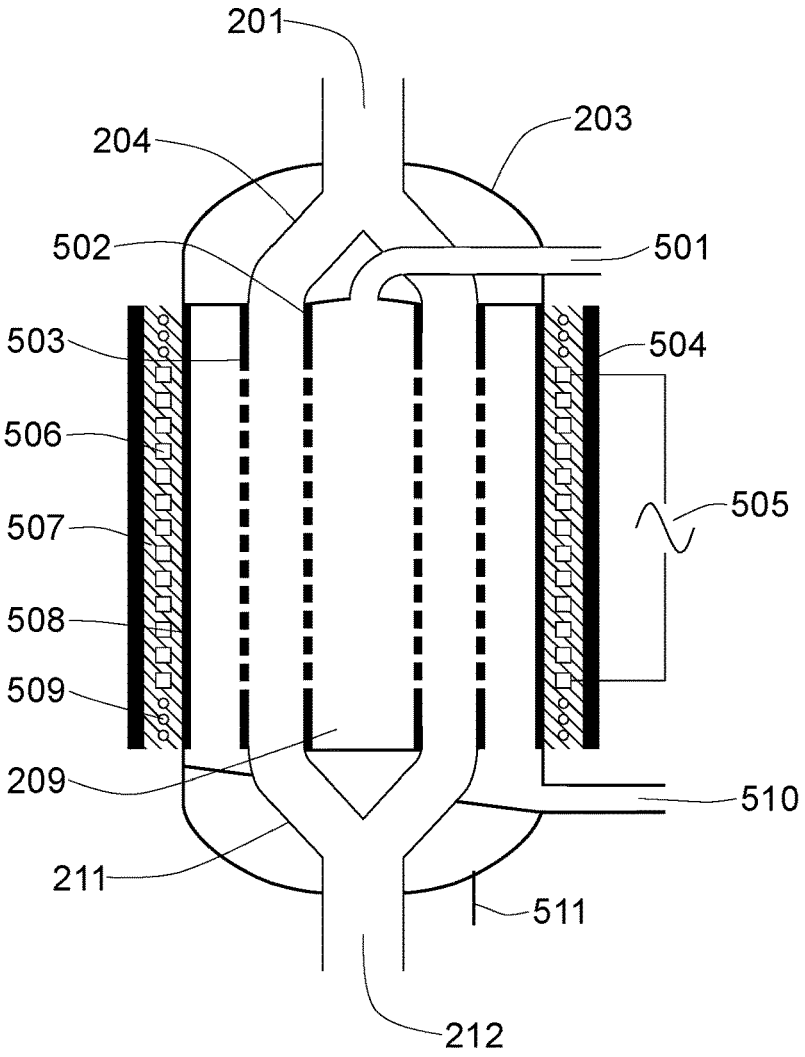

FIG. 5*a* depicts a dual-zone annular cross-flow retort, in some embodiments that include induction coils (506), in this case surrounding the outer containment vessel. Cooling of the coils may be accomplished by passing a suitable fluid, liquid or gas through the coils.

Figure 5B:
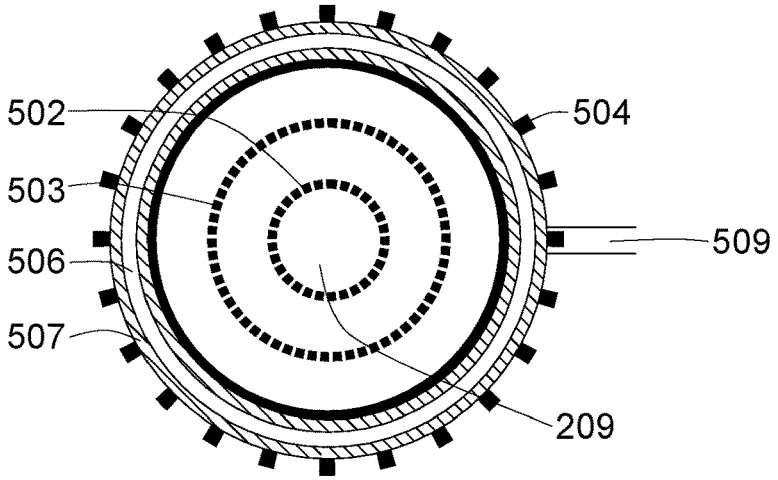

FIG. 5*b* is a plan view of FIG. 5*a*, depicting a certain embodiment intended to maintain a consistent temperature profile across the shale bed.

Figure 6A:
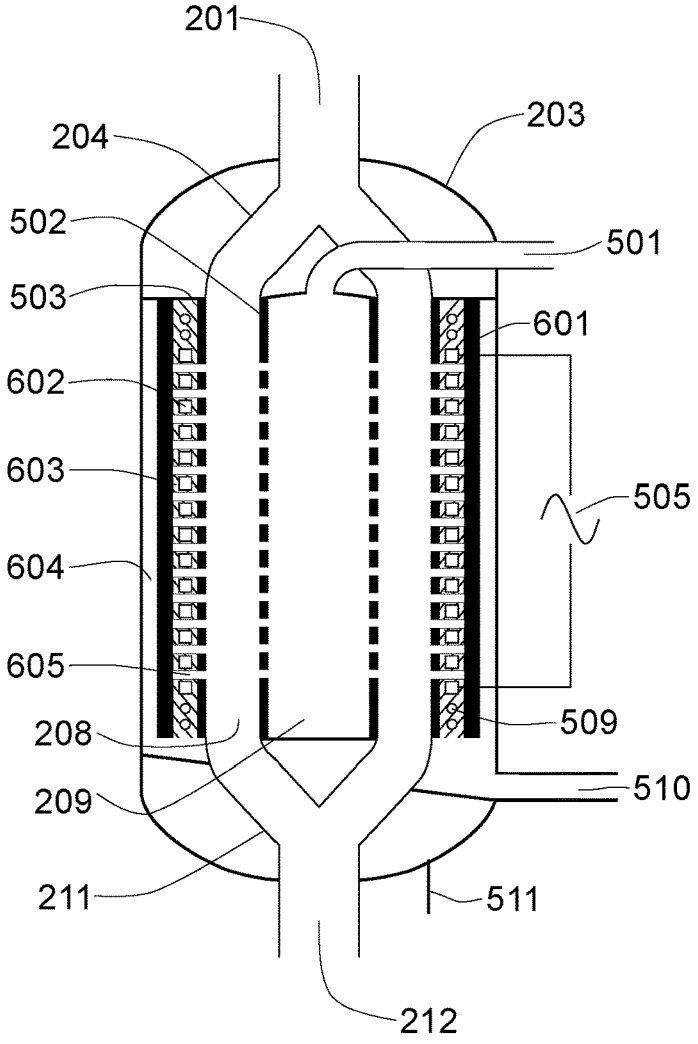

FIG. 6*a* depicts a dual-zone annular cross-flow retort, in some embodiments. FIG. 6*a* shows an alternative implementation of the induction in which the induction coils (602) are placed within the containment vessel. Slots (605) exist through the refractory material and between each turn of the induction coil to allow gas to flow across the bed.

Figure 6B:
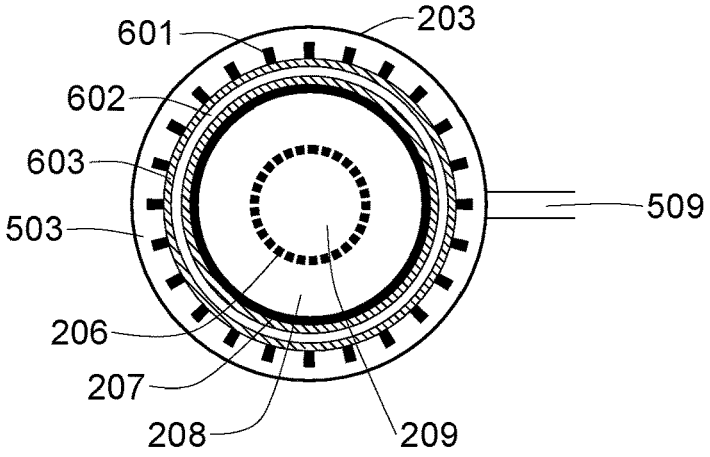

FIG. 6*b* is a plan view of FIG. 6*a*, depicting a certain embodiment intended to maintain a consistent temperature profile across the shale bed.

Figure 7A:
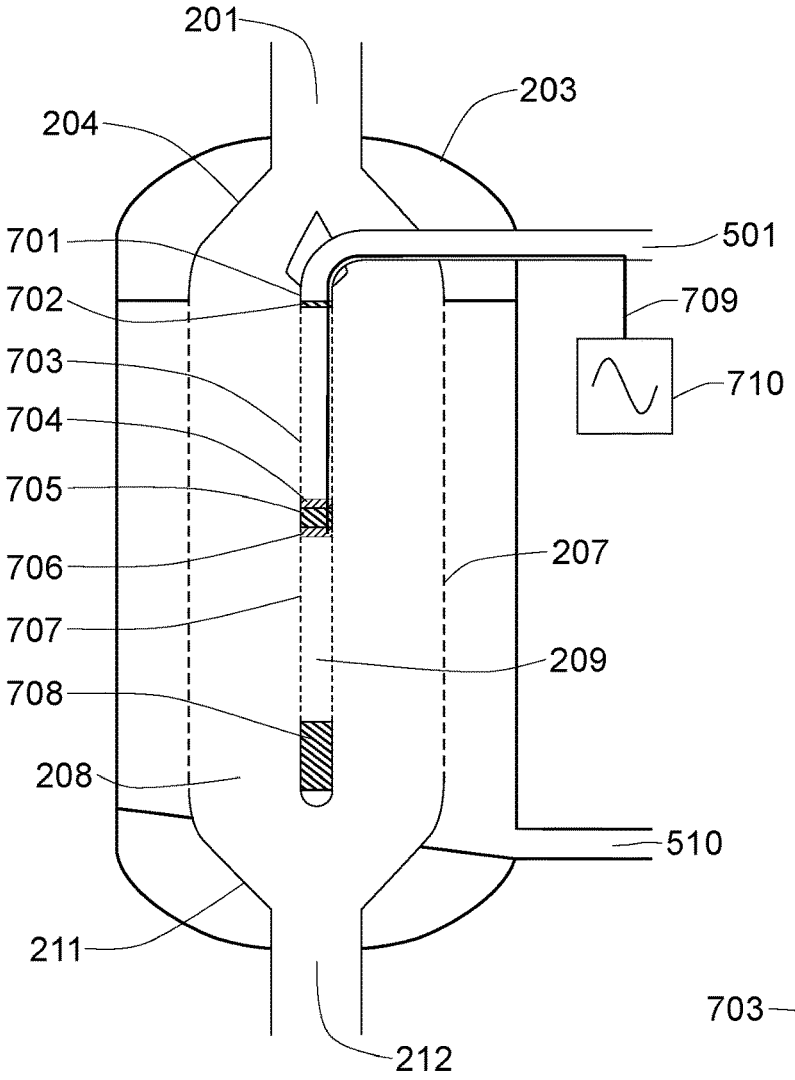

FIG. 7*a* depicts a dual-zone annular cross-flow retort, in some embodiments. In the embodiment of FIG. 7*a*, an RF antenna is used to heat the crushed shale. The antenna (701) in this embodiment is depicted as a slotted dipole.

Figure 7B:
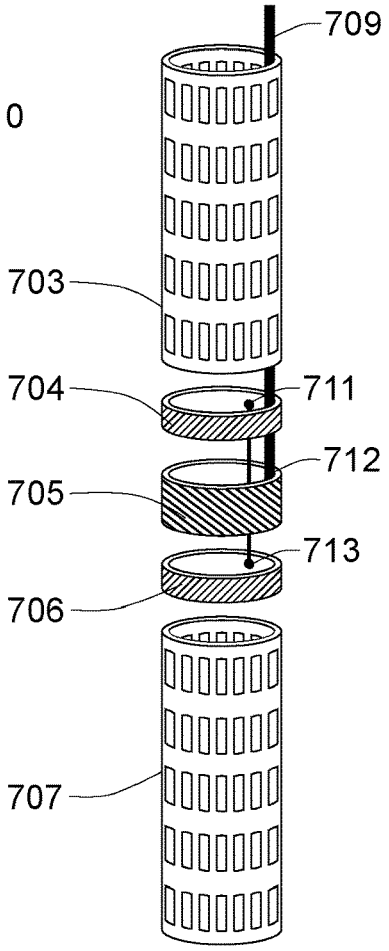

FIG. 7*b* is an exploded view of the center section of the antenna, indicating the dielectric insulator (705) and connection rings (704 and 706) to which the coaxial ground (713) and core (711) are connected. A balun or similar apparatus (712; not shown in FIG. 7*a*) is used for balancing the unbalanced feed to both antennae.

DETAILED DESCRIPTION OF EMBODIMENTS OF THE INVENTION

The systems, methods, and compositions of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of excludes any element, step, or ingredient not specified in the claim. When the phrase" consists of (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms, except when used in Markush groups. Thus in some embodiments not otherwise explicitly recited, any instance of "comprising" may be replaced by "consisting of" or, alternatively, by "consisting essentially of."

The present invention, in some variations, is predicated on the utilization of oil shale in a manner different than existing approaches. In particular, value-added hydrocarbons are directly produced from kerogen from oil shale. It is important to control the manner in which the oil shale is heated as well as the exposure of the oil shale to optimal temperatures. The thermal conditions are controlled in a unique and environmentally friendly manner. Preferred embodiments utilize combinations of electrical heating and cross-flow retorting to achieve uniform and controlled heating, thereby optimizing the production of hydrocarbon feedstocks from kerogen. The principles of the invention may be applied to ex situ systems, in situ systems, or hybrid systems that employ both ex situ and in situ elements.

There are two principal advantages to the apparatus and techniques of some variations of this invention. Existing art and industrial/commercial practices have focused on production of synthetic crude oil (SCO) from kerogen in oil shale. This has not proven itself to be an economically or environmentally suitable use of the resource. By focusing on maximizing recovery of the many hydrocarbons present in kerogen, a long-term, economically viable industry may be sustained.

Prior art has utilized heat of combustion and attendant high emissions of carbon dioxide. Little to no consideration has been paid to the use of electrical energy, particularly (although not exclusively) from renewable sources to minimize the environmental impact.

The systems described herein, even with the necessary ancillary systems, will be relatively small and require significantly less land, infrastructure and thus materials to construct. It is envisaged that the unit operations themselves may be modular in nature and be scalable to a given requirement. This compares with large, existing crude refineries and chemical plants and the attendant infrastructure they require. In fact, it is possible (though not necessary) that these small, modular plants may be sited at the oil shale resource itself—reducing haulage requirements and the necessary infrastructure such implementations require.

A great many, indeed the bulk, of the recoverable hydrocarbon materials are useful in the creation of everyday products. Traditionally, many of these chemicals are derived from the refining of crude oil via complex processes which have focused on production of fuels. These operations are costly—environmentally, socially, and economically. The environmental and economic advantages versus existing art and particularly existing industry are significant.

A process is provided herein in which the kerogen within a mineral matrix, typically oil shale, is pyrolyzed in a continuous fashion using a recycled cross-flow sweep gas to produce "kerogen oil" which is a fluid material containing a wide range of hydrocarbons that may be separated (e.g., via distillation) and processed into high-value products. The approaches herein may create industrially essential hydrocarbon components with a significantly reduced environmental burden.

Historically, the mineral to be retorted would be heated directly or indirectly through combustion of a fossil fuel. This energy may be provided in part or perhaps in full by the light ends, typically hydrocarbons of $C_6$ or $C_7$ and below, produced during pyrolysis. By contrast, techniques and technologies are combined herein to heat the oil shale, in part or in full using electrical energy. This electricity is preferably obtained, in part or in full, from renewable sources.

There are essentially three approaches to retorting oil shale: in situ, ex situ, or a hybrid of the two. Each has positives and negatives. In situ systems avoid extensive mining but add cost and potentially complex, unknown operational risk, significant energy requirements and environmental issues. Ex situ systems require the least energy and are potentially cheaper and easier to manage in terms of process operation and environmental remediation. Of course, ex situ systems require a supply of oil shale and thus mining operations in some form will be required (or were previously performed by some entity). Mining may include, for example, strip, room and pillar or other extraction techniques. A hybrid approach generally requires intermediate amounts of energy and combines elements of in situ and ex situ operations. The pros and cons of each approach need to be carefully considered for each commercial operation.

Embodiments of the invention described herein are framed in terms of an ex situ unit operation. However, it will be understood that the present invention is not limited to ex situ systems. The systems and methods described herein may also be applied to in situ or hybrid operations via vertical or horizontal wells, or within excavations, for example.

Three potential techniques for heating the material to be retorted using electrical energy are described herein: resistive, inductive (i.e., via induction) and dielectric (also known as radio frequency, or electronic). Resistive and inductive heating are both indirect methods of providing energy to the retort material. Resistive and inductive heating provide heat from the outside in by conduction with some radiative effect. Dielectric or radio-frequency heating is a direct method that works from the inside out, heating the kerogen molecule directly. While the implementations noted here consider each to be a discrete process, they may be combined, if desired, to increase efficiency and maximize product recovery.

In some variations, the ex situ retort operation combines a containment vessel with internals arranged to allow a continuously moving thin bed of crushed shale to be contacted with a cross flow of heated sweep gas. The sweep gas carries the evolved vapors, liquid, and mist out the retort (the vapors, liquid, and mist collectively form the kerogen oil). The spent shale exits the retort for further processing.

The cross flow of heated sweep gas, relative to the moving bed of oil shale, is preferably perpendicular or nearly perpendicular. It is not preferred that the flow of heated sweep gas is cocurrent with the direction of moving bed of oil shale. An angle can be defined as the angle between (i) the direction of flow of heated sweep gas and (ii) the direction of flow of moving shale bed. This angle should be greater than 0° and is preferably about 60° to about 120°, more preferably about 75° to about 105°, and most preferably about 85° to about 95° (e.g., about 90). In other embodiments, the cross flow of heated sweep gas, relative to the moving bed of oil shale, is countercurrent, which means the angle is 180°. The angle can also be from about 120° to about 180°.

The practical implementation of this design can take the form of a simple chute (FIG. 1). Crushed shale flows into the top of the retort (101) and down through the retorting zone across which the sweep gas flows (102 and 104). Spent shale exits the bottom of the retort for further processing (105). A more-efficient design appropriate to full-scale process operations may utilize an annular configuration (FIG. 2). The chute design of FIG. 1 may be considered a segment of an annular configuration (FIG. 2), such as for process modeling purposes, as indicated (103).

In an annular configuration, the gas flows through the outer containment vessel (203), through the distribution grate (205). The gas passes across the thin bed containing the moving bed of crushed oil shale via slots or holes within the middle (207) wall and out the inner (206) wall, exiting the containment vessel (210). The direction of gas flow—inner vessel to outer, or vice versa—is typically not critical to basic operation and would be determined by the overall retort design and operation.

The feed system (201 and 204) aims to distribute, as evenly as possible, the crushed oil shale down through the area (208) bounded by the inner (206) and middle (207) walls. From here the crushed shale progresses, under gravity in the case of a vertical retort, or via an auger or similar device in a horizontal configuration, through the retort in a continuous or semi-continuous fashion (semi-continuous means that the continuous operation may be intermittent but is not a batch mode).

Cross-flow sweep gas enters the unit (201), preheated to near pyrolysis temperatures of 300° C. to 450° C. This stream typically is at least about 50% to 99% (or higher) carbon dioxide by mole percent. Nitrogen or other gases may be used in place of carbon dioxide. However, experimental evidence suggests that carbon dioxide has particular merit. $CO_2$ is also actively produced by the process and thus readily available as an internally recyclable stream. When carbon dioxide is within a recycle stream, other components such as carbon monoxide and/or light hydrocarbons (e.g., $C_1$-$C_7$ hydrocarbons) may be present.

Both the simple chute and the annular configuration lend themselves to "multi-zone" or "multi-chamber" operation. The zones or chambers may be contiguous as in FIG. 3, with no physical separation, instead using control of flows and pressures to enforce separation. The zones or chambers may be physically separated sections, fully or partially separated but contained within a single vessel. Of course, it is also possible to have separate retorting vessels joined directly to one another to provide for greater separation using valves (e.g., gate valves). Multiple zones or chambers enable varying operations and temperature profiles, different cross-flow sweep gases, and/or the use of catalysts, for example (without limitation).

As a practical example of multi-zone operation, with reference to FIG. 3, fresh crushed shale may undergo pre-conditioning within the first chamber (301) of the retort. Using a heated stream of gas, this pre-conditioning step drives off water, eliminates remaining air and preheats the crushed shale to near retorting temperatures, such as 200-350° C. The gas exits the first chamber (303) for further processing. The shale then flows into the second chamber (306) where the shale undergoes actual retorting with the cross-flow gas entering from the side (304). This gas impinges directly on the slotted middle vessel wall. As such it may be advantageous or even necessary to better distribute the gas around the outer vessel space. This could take the form of a simple mesh screen (305), or some other means for distribution or flow disruption. An interstitial space between the vessels (302) provides for maintenance and other access.

While the implementations of the retort described here are vertical with shale moving under gravity, horizontal or inclined retorts may be utilized instead. In such variations, the crushed oil shale moves via an auger, rotating drum, or other similar device. It is also noted that the chute and annular configuration of the retort are not themselves strictly necessary; other designs are possible as will be recognized by a skilled artisan.

Retort vessel construction materials vary depending on system configuration, heating method, oil shale composition, and/or product mix. The unit needs to be mechanically stable and chemically unreactive at the retorting temperatures (e.g., a maximum of 500-550° C.) in the presence of carbon dioxide, hydrocarbons ranging from methane to $C_{40+}$ including aromatics and cyclics, nitrogen, sulfur, hydrogen sulfide, water and metal complexes. Even when the incoming oil shale is dried before admittance to the retort, small amounts of water are created during the pyrolysis process. The presence of water should be borne in mind when selecting the retort materials. Typical structural materials are mild steel and/or stainless steels.

It is very desirable to manage or control temperatures, flows and pressures to maximize production of kerogen oil vapor while minimizing cracking. Excess cracking of the kerogen is undesirable both for recovery of high-value products as well as for contamination. While contaminants such as nitrogen, sulfur, and arsenic-containing compounds can be beneficial for the heaviest, asphalt fraction(s), the contaminants are typically undesirable in other off-take products.

In some process-flow embodiments, fresh, dry oil shale is first crushed and screened to a nominal size of about 1/16 inch (1.6 mm) to about 3 inch (76.2 mm), such as about ½ inch (12.7 mm) to about ¾ inch (19.1 mm). The size range is preferably chosen based on the feedstock composition and cost to crush, and further may be chosen to maximize surface area while reducing the chances of plugging, bridging and other problems within the retort. The crushed shale is fed via conveyor or other solids transport equipment to a lock hopper or similar system atop the retort unit. The lock hopper or similar system serves three main purposes: control of feed flow, reduction or elimination of retort gas escape, and reduction or elimination of air ingress.

It should be noted that while the use of a no-valve lock hopper is a preferred approach, it is feasible to use a hopper with a simple gate valve or similar apparatus. Experimental evidence suggests that careful control of pressures and flows (desired anyway for proper operation) combined with the mass of crushed shale can act as a barrier to exfiltration or infiltration of gases.

An important requirement for any sweep gas is that it is oxygen-free. An "oxygen-free" sweep gas means that the molar concentration of $O_2$ in the sweep gas is less than 1%, preferably less than 0.1%, more preferably less than 0.01%, and most preferably less than 0.001%, including no detectible $O_2$. An oxygen-free environment reduces the production of arsenic oxides from mineral arsenides, thereby reducing the amount of arsenic in the product streams. Production of other oxygenates is also reduced or eliminated when an oxygen-free sweep gas is employed. Oxygenates are precursors to gums and varnishes which foul equipment.

Heating of the crushed shale is optimized to produce a pre-determined mix of products. Optimal retorting temperatures are generally between 250° C. and 550° C., such as between 300° C. and 450° C. In various embodiments, the retorting temperature is about 275° C., 300° C., 325° C., 350° C., 375° C., 400° C., 425° C., 450° C., 475° C., 500° C., or 525° C., including all intervening ranges.

Retorting is preferably conducted with a high partial pressure of the carbon dioxide or other sweep gas. In some embodiments, the sweep gas (e.g., carbon dioxide) mass flow rate in the retort ranges from about 0.5 to 2.0 times the oil shale mass flow rate. In various embodiments, the sweep gas (e.g., carbon dioxide) mass flow rate in the retort is about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, or 2.0 times the oil shale mass flow rate through the retort.

Retorting is conducted at the lowest practical overall pressure, such as from about 1 bar to about 10 bar, to achieve the best yields. In various embodiments, the retorting pressure is about 0.5, 0.9, 1.0, 1.1, 1.5, 2, 3, 4, 5, 6, 7, 8, 9, or 10 bar.

While the cross-flow sweep gas can serve as a heat-transfer medium to bring the crushed shale to temperature, experimental evidence suggests it is not by itself optimal. Typically, it is necessary to maintain a higher than desirable inlet temperature to offset heat losses and endothermic heats of reaction across the continuous flowing crushed shale bed. This in turn can create conditions where undesirable cracking of the kerogen may occur. As the gas proceeds across the bed, the temperature profile falls, as the gas gives up its thermal energy to the shale. Even with a thin bed design, this profile difference can be 100° C. or more, in turn affecting product quality and quantity. Similarly, even with preheating, it takes time for the shale far from the gas inlet to reach the ideal retorting temperature. Likewise, control of the gas temperature is not instantaneous; responses to control and setpoint changes can lag quite significantly.

The present inventors have discovered that the process benefits from a more-responsive, consistent heating method in addition to the hot cross-flow sweep gas. In some preferred embodiments, the additional heating is provided, in part or in full, by electrical energy. Electrical heating has the added benefits of being precise and responsive. Of the overall heating demand of the heated retorting unit, electrical heating may supply about, or at least about, 20%, 30%, 40%, 50%, 60%, 70%, 80%, 90%, 95%, 99%, or 100%, in various embodiments.

The electrical energy may be supplied, in part or in full, by renewable energy sources, such as solar-generated electricity, wind-generated electricity, hydroelectricity, biomass-derived electricity, etc. Of the overall usage of electrical energy for the heated retorting unit, renewable energy may supply about, or at least about, 5%, 10%, 20%, 30%, 40%, 50%, 60%, 70%, 80%, 90%, 95%, 99%, or 100%, in various embodiments utilizing renewable energy.

Resistive heating is the most straightforward method for heating material via electrical energy. Resistive heating involves current passed through an electrically resistive material, generating heat by Joule heating, also known as Ohmic heating.

There are several possible methods for heating retorts in this manner. While external heating of the retort structure using resistive heating is feasible, for example using heating tapes, this is not a particularly efficient approach. In this scenario, heating of the oil shale occurs principally through conduction and radiation with some further convective heating from the cross-flow sweep gas. However, heating is limited to the outermost layer of oil shale, not most of the bulk material. Given the principle reason for this approach of adding secondary energy to improve the temperature profile across the thin bed, external electrical heating is not ideal.

Tubular heating rods may be employed in some embodiments. Magnesium oxide (MgO) insulated NiCr (Nichrome) wire contained within a steel, stainless steel, incoloy or other suitable metal tube offers a robust solution. Heating rods may be placed vertically (in the case of a gravity-fed, vertical retort) down through the shale (FIG. 4*a*, 401), held in place by minimally obstructive supports (402). The heaters are arranged in a suitable pattern to maximize conduction of heat to the crushed shale across, and through, the height of the bed. An example of such a configuration is shown in FIG. 4*b*.

Alternatives to this approach may employ thick film heaters in the form of plates or baffles within the retort. Plates or baffles may be made from a range of materials, such as steels, stainless steels or even ceramics. Thick film heaters have the added benefit of uniform heating across their surfaces. Such heating is, as previously noted, desirable to maximize recovery of kerogen oil.

Another method for utilizing electrical energy for heating is that of induction. Induction is a highly efficient method of heating electrically conductive materials. Common applications include induction furnaces, welding, brazing and household cooking. By passing a rapidly alternating current through a coil of conductive material to form an electromagnet, the field generated can induce currents, termed eddy currents, within an electrically conductive material placed within the coil.

These eddy currents, caused by the electrical resistance of the material, generate heat by Joule (or Ohmic) heating—as occurs in resistance heating. This effect occurs predominantly on or near the surface of the material being heated and thus is termed the "skin effect". Even greater efficiency can be obtained if the material within the coil is ferromagnetic, for example iron, steel, zinc, or cobalt or their alloys. Here further heating occurs, up to the materials Curie point, due to hysteresis losses caused by the rapidly changing magnetic field—so called hysteretic heating.

Oil shale is not electrically conductive and thus cannot be heated directly by induction. However, by contacting the crushed shale with something that is conductive, heat may be indirectly transferred by conduction and/or radiation.

There are at least three solutions to this problem. One solution utilizes the retort shell itself, since the shell is typically made from conductive steel or stainless steel (or conductive additives may be incorporated into the shell). A second solution employs position-fixed conductive structures within the retort. A third solution adds, to the crushed shale, conductive media in the form of solids (e.g., steel balls) or fluids.

As described for resistive heating, heating the shell of the retort, while feasible, is not ideal. A key aim of this type of heating is to maintain a more-consistent temperature profile throughout the material. The crushed shale is not normally stirred or mixed. Thus, by solely heating the shell, only the outside (effectively the boundary layer) of shale is heated directly, with poor heating of the bulk material. For very thin beds, this first solution may still be an effective approach.

In the second solution, rods, plates, mesh, or some other suitable structure may be placed within the retort to act as heating targets. Placement may be similar to that of the tubular heating rods in the resistive heating implementation (401), for example. The most significant downside to this approach is non-uniform contact with the crushed oil shale. If the average size of the crushed shale is small, it is possible to design and implement a layout that maximizes contact time between the shale and heating structures. One benefit of such an approach is that the structures remain fixed within the retort. This eliminates the need for any kind of separation system to recover conductive material added directly to the crushed shale. Further, when the crushed shale is particularly friable, the use of fixed structures may reduce decomposition caused by the addition and mixing of the conductive media.

In some preferred embodiments, the third solution is utilized. In these embodiments, conductive media as solids and/or fluids are directly added to the crushed shale prior to retorting. This solution offers the most adaptable and efficient means to indirect heating by induction. When solid conductive media are employed, the media geometry may be spheres, cylinders, tubes, cubes or some other shape. The material of the conductive media is preferably ferromagnetic with softening and Curie points in excess of 450° C. Exemplary solid-media materials include, but are not limited to, iron, steel, and Alnico which is a family of iron alloys composed primarily of iron (Fe), aluminum (Al), nickel (Ni) and cobalt (Co). Exemplary liquid-media materials include, but are not limited to, low-melting-point metals (e.g., tin or mercury) and thermally stable solvents that contain conductive metals or conductive polymers. In some cases, a conductive media component is solid when added prior to retorting but becomes liquid at retort temperatures. An example is tin which has a melting point of 232° C.

The conductive media, when solid, may have various sizes and shapes (aspect ratios). Ideally the conductive media is sized to maximize contact with the crushed shale while minimizing the pressure drop of the cross-flow sweep gas. Crushed shale itself is not isotropic in size or shape. The conductive media may be isotropic or non-isotropic in shape. Good packing of the media within the crushed shale is desired to maximize contact for energy transfer, but perfect packing tends to increase pressure drop which may reduce throughput and increase processing cost. There is a significant body of existing research in determination of close packing density coefficients for a range of materials. Examples for such coefficients include perfect spheres at 0.62 to 0.66, cubes 0.76 and crushed aggregates—not unlike crushed oil shale—0.5 to 0.57.

While the ideal situation is to maximize packing to optimize heat transfer, there are other issues to consider. Packing the conductive media and crushed shale too tightly may plug the retort and severely restrict contact between the shale and cross-flow sweep gas. In turn, this will reduce product removal and increase gas pressure drop. With due consideration of packing densities and aspect ratios, empirical experimental evidence suggests that optimal size ratios are between 1:4 and 2:1 for conductive media to crushed shale. In some embodiments, for example, the conductive media and the crushed shale are about the same size (1:1). The conductive media preferably has a minimum cross section of no less than ⅛ inch (3.2 mm) to reduce plugging problems.

In situations where the size distribution of the crushed oil shale varies significantly, it may be advantageous to vary the size of the conductive media. Experimental evidence suggests there is usually little agitation of the flowing crushed media in the retort at steady state under typical flow conditions. Thus, it is reasonable to assume that mixing of differently sized conductive media will be limited—instead, staying in initial positions within the matrix of crushed shale.

The size of the conductive media is also a factor in determining operation of induction coils. Heating of the media is mostly due to the skin effect (Joule heating). The depth of this heating effect is inversely proportional to the frequency of current applied through the induction coils at any given temperature. Higher-frequency operation of the coils generates heat in a thinner cross section of the media being heated. Conversely, lower frequencies cause heating of a larger cross section. For existing applications of induction heating, such as bending or forming, a critical frequency is often defined. This critical frequency is defined as the effective (heated) depth divided by the actual diameter (or maximum width) or the object.

In the approach described here, there is a benefit to heating the smallest feasible cross section, which requires less power input and increases responsiveness to setpoint and control changes. Indeed, there is no need to heat the interior regions of the conductive media. However, higher-frequency generators increase capital cost. Empirical evidence and existing practices suggest operating frequencies of between 4 kHz and 20 kHz are optimal for conductive-media solid objects in the preferred size ranges. This range should not be considered exclusive. Like all aspects of the design, the frequency or frequency range should be optimized for the given retort and feedstock. In some embodiments, the frequency is lower than 4 kHz or higher than 20 kHz.

The crushed shale, prior to entry to the retort, is combined with the conductive media. There are mechanically many ways known in the art to introduce the conductive media. Considerations include limiting segregation of the disparate materials, maximizing homogeneity, and limiting erosion of the friable crushed shale. Examples include simple mixing via two separate conveyor feeds to the hopper, paddle mixers, etc.

The retort design for both fixed internal media and added conductive media would be broadly similar. In some respects, the retort bares similarity to an open-core induction furnace. The major points of differentiation are the need to admit (FIG. 5*a*, 501) and remove (FIG. 5*a*, 510) a cross-flow gas stream, significantly lower-temperature operation and continuous throughput. The retort topology is derived from the thin bed cross-flow design common to all approaches disclosed herein.

Monitoring of retort temperatures is very important for proper control. Conventional thermocouples are ineffective in the presence of an electromagnetic field. Optical fiber temperature sensors may be used to mitigate this issue. Optical fiber temperature sensors are immune to the magnetic field, can operate in harsh and potentially corrosive environments, and are not potential sources of ignition. As an example, silica-based sapphire probes can operate in excess of the maximum temperatures within the retort.

Some elements of an inductive retort are shown in FIGS. 5*a* and 5*b*. The retort retains its Russian (nesting) doll-like implementation but makes extensive use of refractory materials. Any conductive material within the coil will undergo heating. Heated material between the coil and the conductive objects will reduce or even nullify the heating.

In some embodiments as depicted in FIGS. 5*a* and 5*b*, an induction coil (506) is placed on the outside of the retort and connected to a power and control system (505). The induction coil may be embedded in an epoxy or refractory screed (507). The screed acts as a support, minimizing movement of the coil while being transparent to the magnetic field it generates. A plurality of magnetic yokes (504), typically made from vertically arranged laminated silicon steel, are positioned evenly around the outside and attached to the screed. These magnetic yokes (504) serve double-duty in supporting the screed and the coil it contains, while focusing the magnetic field. This increases efficiency while reducing any external heating of exterior support structures. The induction coil may be manufactured from square or rectangular copper tubing, with each turn notched rather than bent, for example. Constructing the coils in this way improves field strength and minimizes extension of the field above and below the bottom of the coils. To maximize field strength, the distance between each turn of the coil (the pitch) should be kept as small as possible while considering other essential limit parameters such as power input. Heat generated within the coils by their own resistance (and other heat) may be removed using water or other suitable fluid or gas (509). This could include preheating of the cross-flow sweep gas.

Within the outer structure is a refractory lining (508). Suitable seals and supports must be utilized between the refractory and metallic structures such as the shale feed (204), spent shale product (211), vessel top and bottom caps (203) or any other such interface. A connection to ground (511) should be fitted to ensure all metal components are at the same potential. The cross-flow sweep gas exits the crushed shale/conductive media moving bed—carrying with it the kerogen oil as a vapor, liquid and mist. Maximum temperatures likely to be encountered here are less than about 525° C., so a high-temperature refractory is not required. However, the lining also serves to insulate the induction coil from the heat of the retort. Heating the induction coil will increase its resistance which in turn increases the energy required to heat the conductive objects. This becomes a cyclical issue in that higher power in the induction coils itself produces more heat. Thus, minimizing external heating of the induction coil improves efficiency and reduces cooling requirements. Additional insulation may be utilized to limiting heating of the induction coil.

Typical refractory materials for the refractory lining (502, 503 and 508) include mica or other silica, alumina-silicate, or magnesia materials. Where acidic conditions may be encountered, magnesia materials should be avoided. Alternative materials such as carbon-graphite, alumina, zirconia, and others may also be utilized for the refractory materials.

To separate the crushed shale/conductive objects from the outer refractory lining, a slotted barrier (503) may be employed. The slotted barrier is preferably fabricated from a refractory material. Mechanical strength is important because this material needs to be capable of withstanding the stresses imposed on it by the moving shale bed typically at temperatures up to or over 400° C. While increasing the width of the barrier is an option, this decreases the coupling efficiency between the coil and conductive media. Again, this is a design decision. Sequential retorts of smaller height may be employed to address this issue. In some embodiments, additional metallic support structures are included within the retort design.

The crushed shale/conductive media flows between the barrier and the inner vessel or tube. In typical implementations, this inner vessel or tube (502) also is made of non-metallic refractory material. With appropriate control of the coil field strength, it is possible to limit heating of this central structure. This would allow the use of mild or stainless steels either alone or in combination with the refractory material.

An alternative implementation is depicted in FIG. 6*a*. The induction coil (602), given the operating temperatures is embedded in a refractory mortar (603) and situated within the steel or stainless-steel outer containment vessel (203). The coil is surrounded by a plurality of magnetic yokes (601) to focus the field, limit exterior heating, and to support the refractory mortar/coil. This structure serves as the dividing wall between the inner (209) and outer compartments (604), the space through which bed of crushed shale flows (208). This configuration utilizes slots or holes (605) to be introduced in the structure, between the coils, through the refractory mortar. While it is beneficial to minimize the pitch between coils to maximize field strength, the relatively low power used affords some leeway. Care must be given to retaining structural strength of the vessel while limiting gas pressure losses and heating of the induction coil. Cooling of the coil is preferable (509).

The implementation of FIG. 6*a* decreases the coupling distance between the coil and crushed shale/inductive media and thus potentially improves heat output. It does however come at the cost of increased construction complexity. The central chamber or tube constructed from a slotted or otherwise refractory remains (502) as the entry point (501) of the cross-flow sweep gas.

The cross-sectional heating profile may have some unevenness due to the differing coil field strength across the retort. This would cause media closer to the coils to be heated to a greater extent than that further away. Similarly, media near the top and bottom of the coils may undergo uneven heating. This can be accommodated, with some loss of efficiency, by increasing the distance between the coils and the crushed shale/inductive media, thereby increasing the coupling distance.

In some alternative embodiments, a horizontal or inclined channel is utilized rather than a vertical retort. For example, a hairpin induction system may be utilized.

Recovery of the conductive media may be achieved using various methods, the selection of which is a design decision based on available energy, space, size, and friability of the shale versus inductive media, etc. Typical methods include, but are not limited to, magnetic separators, simple screening, or a counter gas-flow system. After recovery, the conductive media may be recycled back to the retort. Where different sizes of conductive media are used, screening may be required. Screening may be completed as part of the separation process or in a separate step.

Resistive and inductive heating are, as previously noted, indirect heating techniques. While resistance heating may be applied to all three approaches (ex situ, in situ or hybrid), induction heating is best suited to ex situ and hybrid methods.

Dielectric heating, otherwise known as radio-frequency (RF) or electronic heating, is another technique for electrically heating the crushed shale. Unlike induction heating which requires the addition of conductive media, dielectric heating directly and without physical contact heats the kerogen macromolecules within the oil shale. Thus, dielectric heating is applicable to all approaches (ex situ, in situ or hybrid).

Dielectric heating occurs as polar molecules with dipole moments rotate to align within an electromagnetic field. As the electromagnetic field oscillates, the dipoles attempt to stay aligned with the field. This movement and the stresses created within and between molecules generate heat. The kerogen within the oil shale behaves as a dielectric material, i.e. a separate dielectric material is not necessary (although optionally could be used, in a similar way as conductive media for induction heating).

As applied to the ex situ thin bed cross-flow retort, with reference to FIG. 7*a*, it is envisaged that a suitably designed antenna (701) or antennas may be placed within the retort to act as the radio source. It is important to consider that antennas designed for far field, atmospheric emission are typically not suited to a near-field enclosed environment. Thus, the antenna should be optimized for near-field energy dissipation over a defined distance—more specifically the depth of the flowing bed within the retort.

The antenna or antennas may take the form of a simple slotted monopole, standard, top-fed or other dipole (701), shaped dipole, or some other configuration placed internally or proximally to the moving crushed oil shale bed. The choice and design of antenna may be influenced by the retort configuration, number of chambers/zone, and/or other factors. For example, a carefully designed pear-shaped antenna may allow for a single retort zone or chamber while retaining the ability to dry or preheat the shale by optimization of the power output along the antenna length.

FIG. 7*a* is an example of one implementation using a slotted dipole antenna. In embodiments employing antenna implementation, power is supplied via transmission line, coaxial, wave-guide or some other implementation. In FIG. 7*a*, a coaxial feed is depicted (709) powered by an external radio-frequency (RF) generator (710) and power supply. In addition to acting as an antenna, the embodiment depicted here operates as the cross-flow sweep gas ingress point (501), gas flowing along the length of the antenna (209), exiting out the upper (703) and lower (707) dipole sections via slots (depicted in FIG. 7*b* and common to the other implementations described herein, resistive and inductive). The dipole is electrically insulated from the gas feed pipe by a suitable dielectric and sealing mechanism (702). In the case of a dipole, power is distributed to the upper and lower dipoles via connections at the center of the antenna length, such total length optimally though not necessarily being one half the wavelength of the frequency utilized. These connections may be in the form of a solid, unslotted section of antenna (704 and 706), the connection being suitably fixed to the ring by welding or other attachment means (711 and 713). A dielectric insulator (705) separates the dipole sections; it may also contain a balun or similar means to ensure balanced distribution of power from the coaxial feed to the upper and lower dipole rings (704 and 706) and prevent the coaxial transmission line from radiating. In some embodiments a dielectric or similar section may be added to the lower antenna (708) to limit or control the size of the RF field generated while allowing sweep gas to continue to flow across the shale bed. Likewise, in other embodiments, a choke may ajoin or be integrated with the dielectric insulator (702) at the top of the antenna to limit or control energy emitted toward the top of the vessel. An alternative dipole implementation may incorporate gas and power feeds entering at the center of the antenna rather than being top-fed. Yet other implementations may incorporate a monopole antenna and ground plane solution.

Attention should be paid to designing the antenna in a way that minimizes negative effects on the radiation pattern—maximizing heating of the shale whilst limiting heating, interference or other issues. The field generated by the antenna should be accommodated to prevent unwanted heating, interference, or other phenomena. The depicted and described implementations are some of the appropriate solutions. One skilled in the art will be able to undertake detailed design and modeling of the retort to determine the most appropriate solution in view of the present disclosure.

Operation of the dielectric system may be optimized by ensuring correct tuning of the voltage standing wave ratio (VSWR) for the required heating task. In multi-zone retorts this may include drying or pre-heating in addition to retorting, conducting, or other process operations.

Further careful monitoring and control of the frequencies and power input of the RF transmitter is important to maximize generation of high-value components from the kerogen oil.

Like the resistance and induction heating implementations, radio-frequency (dielectric) heating may be applied within one or more zones or chambers. Different chambers may allow for different antenna configurations and tuning of the VSWR to match the required objectives of that chamber. Again, as with the resistive and inductive heating implementations, these zones or chambers may be used to preheat and/or pretreat the oil shale—such as to dry, pre-condition, or preheat the crushed shale.

Regardless of heating mechanism(s), kerogen oil extracted during pyrolysis in the form of a vapor, mist, and liquid exits the retort (210) via the central vessel/tube (209). In other configurations, such as shown in FIG. 5*a*, FIG. 6*a* and FIG. 7*a*, the vapor, mist, and liquid exit the retort (510) after passing through (604) the outer vessel (203). From here the kerogen may be sent directly or indirectly to downstream processes. Downstream processes may include fractionation of the kerogen oil to produce high-value intermediates or end products, and/or conversion of components within the kerogen oil or its fractions to other useful components.

Such components include, but are not limited to, asphalt binder, high-cetane additives, odd and even numbered alpha-olefins, base oil stocks, paraffins, waxes including micro-crystalline waxes, amines, pyridines, aromatics, hydrogen sulfide, carbon monoxide, and carbon dioxide. The carbon dioxide rich gas stream, following separation along with other gaseous products, is preferably recycled, at least in part, back to the retort.

A purge stream of gaseous products may be recovered for sale or perhaps for undergoing further processing such as to make syngas (CO and $H_2$). As one example, light hydrocarbons such as methane may be partially oxidized or steam-reformed to generate syngas. As another example, carbon dioxide or other components may be converted to CO or syngas via electrolytic conversion. As with the electrical heating apparatus of the retort, this electrolytic conversion preferably utilizes renewable energy sources. In such embodiments, syngas produced may be used for production of useful chemicals such as methanol or ammonia.

Syngas may also be used for production of synthetic diesel via Fischer-Tropsch synthesis. Synthetic diesel fuel may then be utilized for heavy industrial equipment, including equipment needed for extracting and moving the oil shale. Producing fuel on-site would reduce or even eliminate the need to bring in outside fuels perhaps offsetting the environmental and economic costs of transport.

Spent shale exits the bottom of the retort (212) and may, where appropriate, be combusted to supply additional energy and remove residual contaminants. Once separated it may be cleaned and graded for remediation or for use in a range of products depending on the shale composition. Such products may include, but are not limited to, lightweight aggregates, a source of magnesium, float glass production, horticulture and smelting of iron and steel.

While many advantages exist through the use of electrical heating, there are some negatives. One of, if not the most significant issues is their variability. The wind does not always blow, and the sun does not always shine. As the world moves, ever faster, to the use of renewable sources, this issue has gained much attention and significant research.

There are numerous methods for storing electrical energy, some more efficient or economically viable than others. One common solution is lithium-ion or lithium-polymer batteries, produced at large scale worldwide. Recent advances and scale-up in manufacturing have enabled grid-capable battery capacities to be produced economically. Alternatives to lithium-battery storage include supercapacitors, fuel cells (typically hydrogen), compressed or liquified air, redox flow, and flywheels. Each solution has positives and negatives to be considered during front-end design. Battery and storage research are accelerating, and the storage methods mentioned here should not be considered limiting.

It is noted that in the present invention, the electrical energy need not strictly be derived from renewable sources. While the aim is to reduce the release of carbon dioxide and other greenhouse gases, there will nonetheless be benefits in combusting certain materials, such as light hydrocarbons of $C_6$ or $C_7$ and less. Combustion may also be applied to other recovered or post-processed components. It could prove more environmentally friendly and economically beneficial to combust these components, clean the resulting gases, and recover the resulting products, including carbon dioxide, sulfur, etc. In this scenario it may be possible to use co-generation (combined heat and power) to generate not only thermal energy for process heating but also electrical energy for use in the retort and other operations. This configuration would maximize energy recovery. Energy recovered within the process is energy not required from external, possibly polluting sources.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

This disclosure hereby incorporates by reference U.S. Patent Application Publication No. 20180355254 A1, published on Dec. 13, 2018.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A method of retorting oil shale containing kerogen, said method comprising:

(a) continuously or semi-continuously feeding oil shale into a heated retorting unit comprising a middle wall disposed internally within said heated retorting unit, and an inner wall disposed internally within said heated retorting unit, wherein said middle wall is configured with middle slots and/or middle holes, and wherein said inner wall is configured with inner slots and/or inner holes;

(b) heating said heated retorting unit, at least partially, using electrical energy;

(c) in said heated retorting unit, converting said kerogen into one or more retorted streams comprising kerogen oil in the form of a vapor, mist, and/or liquid;

(d) conveying a cross-flow sweep gas across a continuously or semi-continuously moving thin bed of said oil shale within said heated retorting unit, wherein said continuously moving thin bed of said oil shale is bounded by said middle wall and said inner wall, and wherein said heated cross-flow sweep gas carries said kerogen oil out of said heated retorting unit;

(e) recovering or further processing said kerogen oil; and (f) recovering or further processing spent, kerogen-depleted oil shale.

2. The method of claim 1, wherein said method is ex situ oil-shale retorting.

3. The method of claim 1, wherein said method is or includes in situ oil-shale retorting.

4. The method of claim 1, wherein said electrical energy in step (b) is at least partially renewable electrical energy.

5. The method of claim 4, wherein said renewable electrical energy is selected from the group consisting of solar-generated electricity, wind-generated electricity, hydroelectricity, biomass-derived electricity, and combinations thereof.

6. The method of claim 1, wherein said heating in step (b) is provided by resistive heating.

7. The method of claim 1, wherein said heating in step (b) is provided by inductive heating, and wherein said oil shale is contacted with conductive media that heats up via induction.

8. The method of claim 7, wherein said conductive media is contained in walls of, and/or internally fixed structures within, said heated retorting unit.

9. The method of claim 7, wherein said conductive media is a solid and/or a fluid that is continuously or semi-continuously introduced to, and recovered from, said heated retorting unit.

10. The method of claim 1, wherein said heating in step (b) is provided by dielectric heating.

11. The method of claim 1, wherein said heated retorting unit is operated at a retorting temperature from about 250° C. to about 550° C., and wherein said heated retorting unit is operated at a retorting pressure from about 1 bar to about 10 bar.

12. The method of claim 1, wherein said cross-flow sweep gas comprises at least 50 mol% carbon dioxide.

13. The method of claim 1, wherein said cross-flow sweep gas comprises less than 1 mol% oxygen.

14. The method of claim 13, wherein said cross-flow sweep gas comprises less than 0.1 mol% oxygen.

15. The method of claim 1, wherein the ratio of mass flow rate of said cross-flow sweep gas to mass flow rate of said continuously or semi-continuously moving thin bed of said oil shale is from about 0.5 to about 2.0.

16. The method of claim 1, wherein said cross-flow sweep gas is preheated to a temperature from about 300° C. to about 450° C. prior to step (d), and wherein said heated retorting unit is not heated solely with said electrical energy.

17. The method of claim 1, wherein the direction of said cross-flow sweep gas and the direction of said continuously or semi-continuously moving thin bed of said oil shale form an angle that is selected from about 60° to about 120°.

18. The method of claim 1, wherein said cross-flow sweep gas is perpendicular relative to the direction of said continuously or semi-continuously moving thin bed of said oil shale.

19. The method of claim 1, said method further comprising generating a plurality of hydrocarbons from said kerogen oil by separations, reactions, or a combination thereof.

20. The method of claim 1, said method further comprising producing one or more products selected from the group consisting of asphalt binder, high-cetane additives, odd and/or even numbered alpha-olefins, base oil stocks, paraffins, waxes including micro-crystalline waxes, amines, pyridines, aromatics, hydrogen sulfide, carbon monoxide, and carbon dioxide.

* * * * *